US005540131A

United States Patent [19]

Shigenaga

[11] Patent Number: 5,540,131

[45] Date of Patent: Jul. 30, 1996

[54] FOOT PEDAL FOR A DRUM

[75] Inventor: Fumihiro Shigenaga, Hamamatsu, Japan

[73] Assignee: Yamaha Corporation, Shizuoka, Japan

[21] Appl. No.: 461,639

[22] Filed: Jun. 5, 1995

[30] Foreign Application Priority Data

Oct. 27, 1994 [JP] Japan ..... 6-263728

[51] Int. Cl.[6] ..... G10D 13/02

[52] U.S. Cl. ..... 84/422.1

[58] Field of Search ..... 84/422.1, 422.2, 84/422.3

[56] References Cited

U.S. PATENT DOCUMENTS 5,398,584 3/1995 Liao ..... 84/422.1

FOREIGN PATENT DOCUMENTS 55-11033 3/1980 Japan ..... G10D 13/02

58-43031 9/1983 Japan ..... G10D 13/02

58-43035 9/1983 Japan ..... G10D 13/02

*Primary Examiner*—Patrick J. Stanzione

*Attorney, Agent, or Firm*—Koda and Androlia

[57] ABSTRACT

In a foot pedal for a drum, the beater pivots so as to strike the drum head when a pedal board is depressed by the player. The beater is provided on a rocker which is rotatable on a horizontal shaft and is connected to a pedal board via a belt that transfers the pedal depression force from the pedal board to the rocker so that rocker rotates to pivot the beater. A feeling adjustment member is detachably provided on the rocker. The feeling adjustment member is movable in the direction of the length of the belt on the peripheral surface of the rocker, and when the distance from the center of rotation of the rocker to the pedal depressing force transmission member is changed by moving the feeling adjustment member, the feeling of the depth of the depression of the pedal board is changed.

2 Claims, 3 Drawing Sheets

PRIOR ART

FOOT PEDAL FOR A DRUM

BACKGROUND OF THE INVENTION

1. Field of the Invention

The present invention relates to a foot pedal for a drum in which the drum head of a bass drum is struck by the depression of a foot board with the foot and more particularly to a foot pedal for a drum in which the feeling during the depression of the foot board can be varied to suit the player.

2. Prior Art

Various drum foot pedals of this type, in which a beater is caused to pivot by the depression of a foot board so that the beater strikes the drum head of a bass drum, have been proposed in the past (examples: Japanese Utility Model Application Publication No. 58-43035, etc.).

FIG. 4 shows a conventional example of a foot pedal for a drum. This conventional foot pedal may be described briefly as follows: A drum foot pedal 1 includes a pedal frame 2 which is positioned on the floor surface. This pedal frame 2 is made up of a frame main body 2A, a pair of left and right supporting columns 2B which are installed upright on the upper surface of the frame main body 2A, and a heel 2B which is connected to the frame main body 2A via a connecting member 3, etc. A clamping member (not shown in the drawing) which holds the tightening frame (or hoop) of a bass drum which is not shown in the drawings is attached to the frame main body 2A. A pivoting shaft 4 is installed between the upper ends of the pair of supporting columns 2B, 2B, and a rocker 5 is attached to the center of the pivoting shaft 4. Furthermore, a beater 6 which strikes the drum head is installed on the rocker 5 via a beater rod 7, and one end of a pedal depressing force transmission member 9 which transmits the depressing force of a foot board 8 to the beater 6 is connected to the rocker 5. The rocker 5 is formed so that it has a fan shape when seen from the side as shown in FIG. 4 or a "J" shape when seen from the side as shown in FIG. 5, etc, and one end of the pedal depressing force transmission member 9 is fastened to the upper circumferential surface of the rocker 5 by means of fastening screws 10. etc. A timing belt, a flexible leather or plastic band (FIG. 4) or a chain (FIG. 5), etc. may be used as the pedal depressing force transmission member 9. The foot board 8 is formed as a flat plate of sufficient size to accommodate the foot. The front end of the foot board 8 is connected to the other end of the pedal depressing force transmission member 9, and the rear end of the foot board 8 is connected to the heel 2C so that the foot board 8 is free to pivot. The upper end of a return spring 12 which imparts a pivoting habit to the foot board 8 in the return direction is connected to one end of the pivoting shaft 4 via a cam plate 13, and the lower end of this return spring 12 is connected to a spring receiving member 14 which is installed on the lower end of one of the supporting columns 2B.

In the drum foot pedal 1 constructed as described above, the foot board 8 is ordinarily maintained at a prescribed inclination with the front end thereof lifted as shown in the figures by the spring force of the return spring 12. When a depressing force is applied to the foot board 8 in this state, the pedal depressing force transmission member 9 is pulled downward, and as a result, the beater 6 pivots together with the pivoting shaft 4 and strikes the drum head of the bass drum. The maximum angle of depression of the foot board 8 in this case is approximately 15°. When the depressing force is removed from the foot board 8 after the beater 6 has truck the drum head, the foot board 8 is caused to pivot upward by the spring force of the return spring 12, and the foot board 8 returns to its initial position.

However, in drum foot pedals of this type, the feeling (operating sensation) during depression of the foot board varies depending upon the shape of the rocker 5. For example, in the case of the rocker shown in FIG. 4 which is a fan-shaped rocker wherein the portion contacted by the pedal depressing force transmission member 9 is formed as a curved surface with a radius of R from the center of rotation (i.e., the center of the pivoting shaft 4), the rotational speed of the rocker remains constant regardless of the angle of rotation, even if a uniform depressing force is applied; as a result, the feeling is also constant. On the other hand, in the case of a rocker, as shown in FIG. 5, with a different shape in which the distance from the center of rotation to the fastened end 9*a* of the pedal depressing force transmission member 9 is short and the distance of the pedal depressing force transmission member 9 from the center of rotation increases moving away from the fastened end 9*a* in the direction of length of the pedal depressing force transmission member 9, the rocker 5 can be caused to rotate quickly by a small depressing force in the initial stage of depression, but it requires a gradually larger depressing force. Furthermore, when the depressing force is released immediately after the depressing operation, the rocker 5 returns quickly.

As seen from the above, the feeling during the depressing operation varies depending upon the shape of the rocker 5. However, since the shape of the rocker 5 itself is invariable, the feeling during the depressing operation cannot be changed to suit the player. In other words, the drum can only be played with a specified feeling which is determined by the shape of the rocker. Accordingly, in cases where it is desired to alter the feeling in accordance with the genre of the music, it is necessary to replace the drum foot pedal with a foot pedal equipped with a rocker whose shape is suited to the desired feeling.

SUMMARY OF THE INVENTION

Accordingly, the present invention was devised in light of the conventional problems described above.

The object of the present invention is to provide a foot pedal for a drum which is designed so that the feeling during the depressing operation of the foot pedal can be varied in a simple manner as desired by the player without any need for replacement of the rocker or replacement of the foot pedal itself.

In order to achieve the object, the invention is characterized in that in a foot pedal for a drum in which a rocker installed on a pivoting shaft and a foot board are connected by a pedal depressing force transmission member, and a beater is caused to pivot by the depression of the foot board so that the beater strikes the drum head, a feeling adjustment member which can be moved and adjusted in the direction of length of the pedal depressing force transmission member is interposed between the rocker and the pedal depressing force transmission member.

Furthermore, the invention is characterized in that in the foot pedal as described above, the feeling adjustment member is installed so as to protrude from the circumferential surface of the rocker and to be moved and adjusted.

In the invention, as a result of the interposition of the feeling adjustment member between the rocker and the pedal depressing force transmission member, the pedal depressing force transmission member can be caused to float up from the circumferential surface of the rocker so that the distance between the center of rotation of the rocker and the pedal depressing force transmission member is increased.

DETAILED DESCRIPTION OF THE INVENTION

Below, the present invention will be described in greater detail in terms of an embodiment which is illustrated by the accompanying figures.

Figure 1:
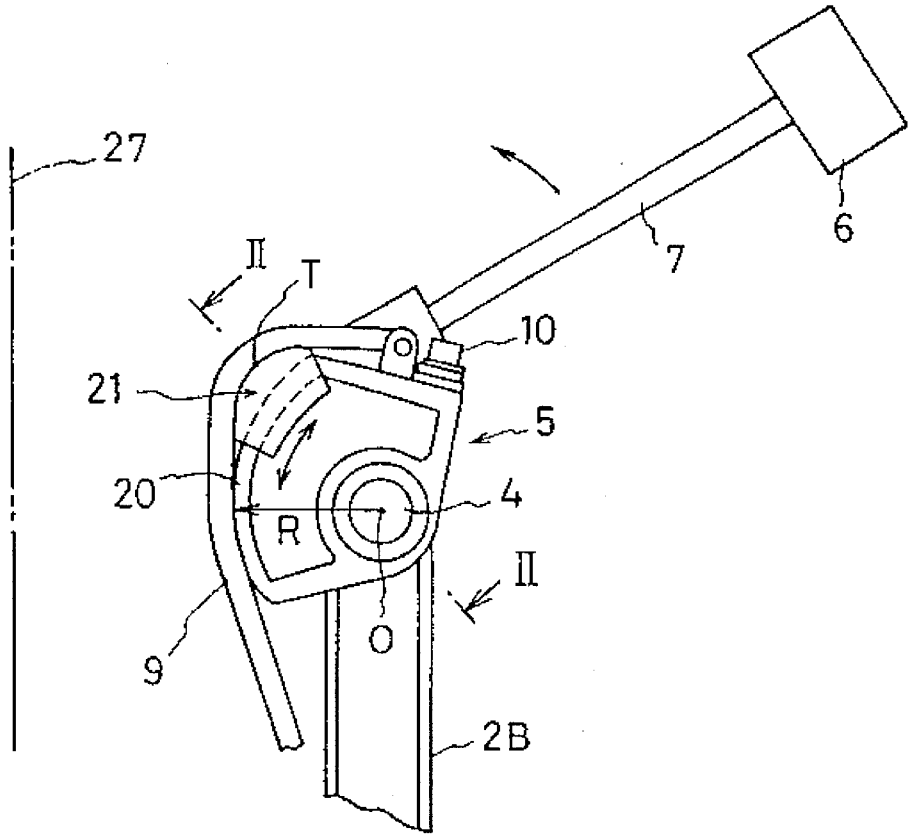
FIG. 1 is a side view of a rocker element according to one embodiment of the drum foot pedal of the present invention.
Figure 2:
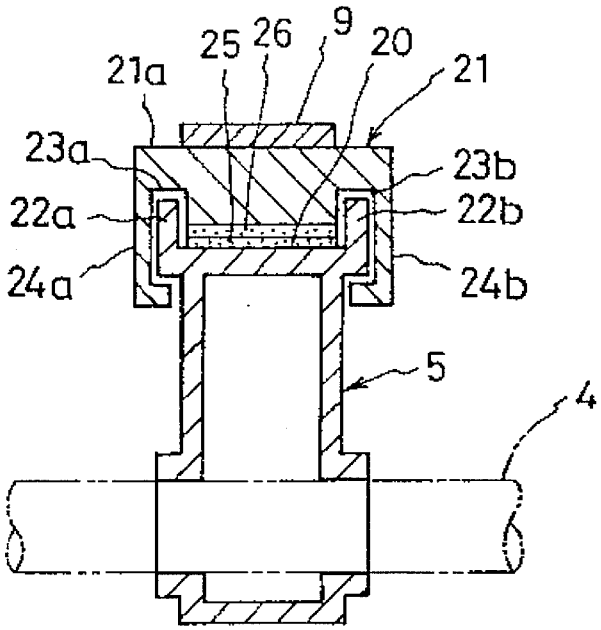
FIG. 2 is a sectional view taken along the line II—II in FIG. 1.
Figure 5:
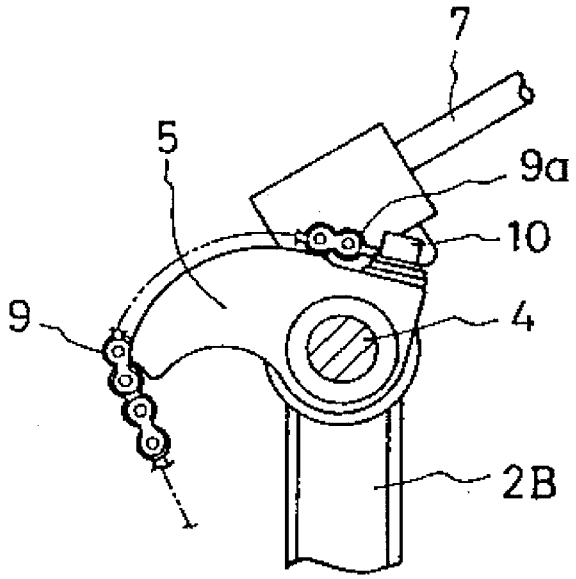
FIG. 5 is a side view of another conventional example of a rocker.
Figure 4:
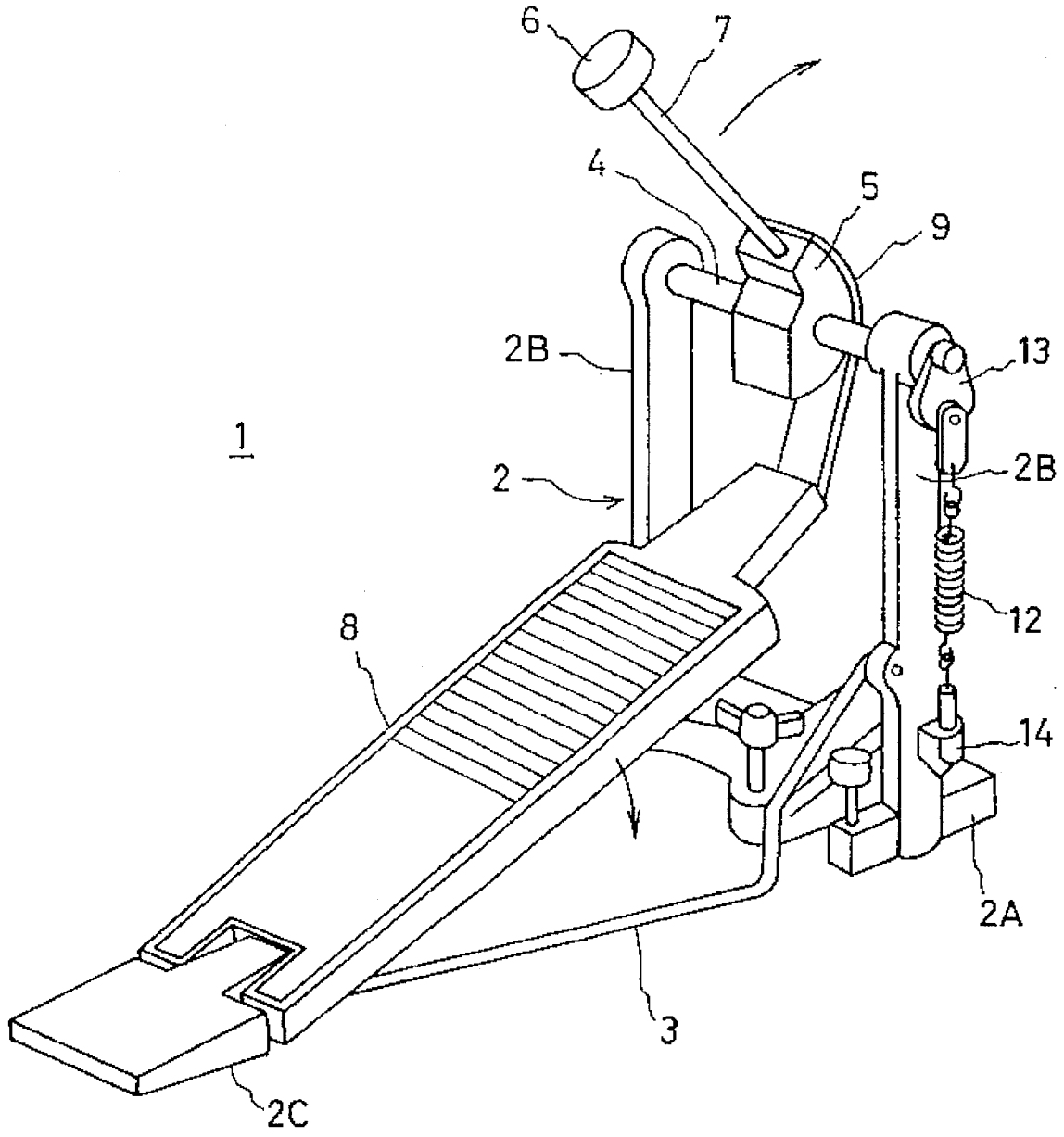
FIG. 4 is a perspective view of a conventional example of a drum foot pedal.

FIG. 1 is a side view of a rocker element which illustrates one embodiment of the foot pedal for a drum provided by the present invention. FIG. 2 is a sectional view along line II—II in FIG. 1. Furthermore, the components which are the same as in FIGS. 4 and 5 are indicated by the same symbols, and a description of such components is omitted. The figures illustrate an embodiment in which the present invention is applied to a drum foot pedal that is equipped with a rocker 5 which is fan-shaped when viewed from the side. The circumferential surface 20 of the rocker 5 along which a pedal depressing three transmission member 9 is provided is a circular-arc surface with a radius of R from the center of rotation O of the rocker 5. A feeling adjustment member 21 is installed on the circumferential surface 20 so that the member 21 can be moved and adjusted in the circumferential direction, i.e., in the direction of length of the pedal depressing force transmission member 9, in a manner that the member 21 can be freely attached and detached. The feeling adjustment member 21 which is formed in an integral single unit from a synthetic resin, etc. has a concave upper surface 21*a*, and engagement grooves 23*a*, 23*b* with which flange portions 22*a*, 22*b* formed facing each other on opposite edges of the outer circumferential surface of the rocker 5 are respectively capable of engaging are formed on the undersurface of the feeling adjustment member 21 near both edges of the member 21. The upper surface 21*a* protrudes above the circumferential surface 20 of the rocker 5. The two side parts 24*a*, 24*b* of the feeling adjustment member 21 which form the side wall portions of the engagement grooves 23*a*, 23*b* are formed as thin parts, so that the side parts 24*a*, 24*b* possess elasticity. Furthermore, the lower ends of the side pans 24*a*, 24*b* are bent inward at roughly right angles so that the flange portions 22*a*, 22*b* are enveloped, thus preventing the feeling adjustment member 21 from falling off of the rocker 5. In order to attach the feeling adjustment member 21 to the outer circumference of the rocker 5, it is necessary merely to deform the two side parts 24*a*, 24*b* elastically outward and insert the flange portions 22*a*, 22*b* into the engagement grooves 23*a*, 23*b*. A surface fastener 25 is secured to the circumferential surface 20 of the rocker 5 by means of an adhesive agent, etc., and a surface fastener 26 which faces the surface fastener 25 is also secured to the undersurface of the feeling adjustment member 21. The feeling adjustment member 21 is provided on the rocker 5 by means of these surface fasteners 25 and 26 so that the member 21 can be moved and adjusted with respect to the rocker 5 and that the member 21 can be freely attached and detached. The attachment structure of the feeling adjustment member 21 is not limited to the surface fasteners 25, 26, and it is also possible to attach the feeling adjustment member 21 by means of screws, etc. The pedal depressing force transmission member 9 which transmits the depressing force of the foot board 8 (see FIG. 4) to the beater 6 is provided so as to be along the circumferential surface 20 of the rocker 5 and the upper surface 21*a* of the feeling adjustment member 21. As a result, the portion of the pedal depressing force transmission member 9 that faces the feeling adjustment member 21 is floated up from the circumferential surface 20 of the rocker 5.

Other structure is the same as in the conventional drum foot pedal illustrated in FIG. 4.

In the drum foot pedal constructed as described above, when the foot board is depressed so that the pedal depressing force transmission member 9 is pulled downward, the beater rod 7 pivots together with the pivot shaft 4 in the direction indicated by the arrow in FIG. 1. As a result, the beater 6 strikes the drum head 27.

In this case, in the conventional rocker which is not equipped with the feeling adjustment member 21, the distance from the center of rotation O of the rocker 5 to the circumferential surface 20 is fixed as described above. As a result, the rotational speed of the rocker 5 always remains constant even if the foot board is depressed with a uniform force, and there is no change in the feeling. In the present invention, however, the feeling adjustment member 21 is provided; therefore, a feeling different from that of a conventional foot pedal can be obtained. In other words, when the feeling adjustment member 21 is positioned at the upper end of the circumferential surface 20 of the rocker 5 as shown in FIG. 1, the distance from the center of rotation O of the rocker 5 to the pedal depressing force transmission member 9, i.e., the length of the rotating arm of the rocker 5, becomes the maximum at the apex T of the feeling adjustment member 21. As a result, a depressing force immediately prior to the completion of the depressing becomes unnecessary, and the rocker 5 can be caused to rotate quickly.

Figure 3:
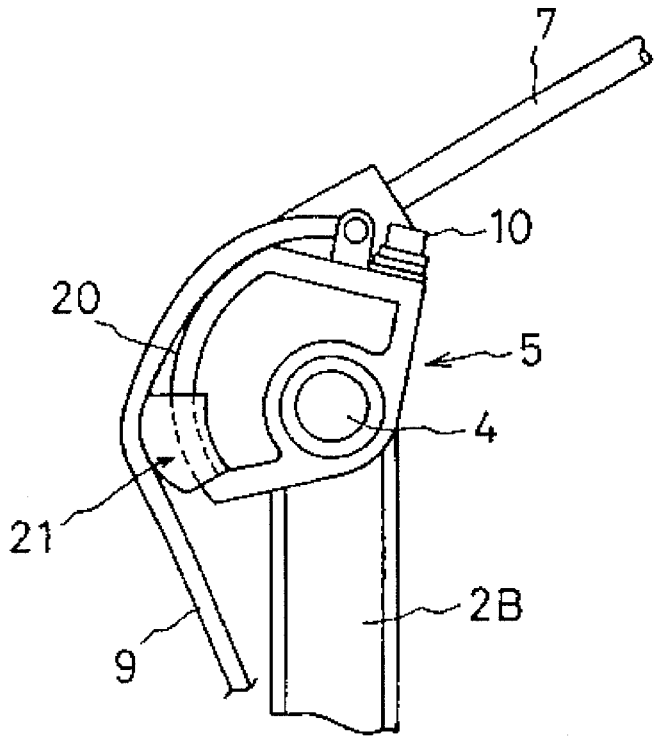
FIG. 3 is a side view of a case in which the position of the feeling adjustment member has been changed.

On the other hand, when the feeling adjustment member 21 is provided at the lower end of the circumferential surface of the rocker 5 as shown in FIG. 3, the distance from the center of rotation O of the rocker 5 to the pedal depressing force transmission member 9 is long during the initial stage of the depressing operation; as a result, a light depressing force can be used at the time that the depressing operation is initiated. Furthermore, when the depressing force is released immediately following the depressing operation, the rocker 5 can return quickly. The feeling in this case is roughly the same as the feeling obtained in the case of the rocker with a "J" shape when viewed from the side as shown in FIG. 5.

Furthermore, if the feeling adjustment member 21 is removed, a feeling similar to that of the conventional rocker shown in FIG. 4 can be obtained.

Thus, in such a drum foot pedal as described above, the feeling during the depressing operation can be adjusted as desired by the player. Accordingly, the drum can be used for various genres of music without any need for replacing the rocker 5 with a rocker of a different shape or replacing the drum foot pedal with a drum foot pedal that has a rocker of a different shape. Furthermore, since it is only necessary to move the feeling adjustment member 21 along the circumferential surface 20 of the rocker 5, handling is simple and easy.

In the embodiment above, the feeling adjustment member 21 is installed on the rocker 5 so that the feeling adjustment member 21 is moved and adjusted and so that the member 21 can be freely attached and detached. However, the present invention is not limited to such an arrangement. It is of course also be possible that the feeling adjustment member 21 is provided on the pedal depressing force transmission member 9 in such a manner that the member 21 is moved and freely attached and detached. However, in cases where the feeling adjustment member 21 is provided on the pedal depressing force transmission member 9, it is necessary to consider the material used for the member 21, since the pedal depressing force transmission member 9 itself bends; thus, it is preferable to provide the feeling adjustment member 21 on the rocker 5.

Furthermore, in the embodiment described above, the upper surface of the feeling adjustment member 21 is formed with a concave shape. However, the present invention is not limited to such a shape; and it is also possible to form the upper surface with some other appropriate shape such as a trapezoidal shape, etc.

As described above, the drum foot pedal of the present invention is characterized in that in a foot pedal for a drum in which a rocker installed on a pivoting shaft and a foot board are connected by a pedal depressing force transmission member, and a beater is caused to pivot by the depression of the foot board so that the beater strikes the drum head, a feeling adjustment member which can be moved and adjusted in the direction of length of the pedal depressing force transmission member is interposed between the rocker and the pedal depressing force transmission member. Accordingly, a feeling desired by the player can be obtained merely by moving the feeling adjustment member, and the drum can be used for various genres of music.

Furthermore, in the drum foot pedal of the invention the feeling adjustment member is installed on the rocker. Accordingly, the feeling adjustment member can be provided more securely.

I claim:

1. A foot pedal for a drum characterized in that in a foot pedal for a drum in which a rocker installed on a pivoting shaft and a foot board are connected by a pedal depressing force transmission member, and a beater is caused to pivot by the depression of said foot board so that said beater strikes a drum head, wherein a feeling adjustment member which can be moved and adjusted in a direction of length of the pedal depressing force transmission member is interposed between the rocker and the pedal depressing force transmission member.

2. A foot pedal for a drum according to claim 1 characterized in that the feeling adjustment member is provided so as to protrude from a circumferential surface of the rocker and to be moved and adjusted.

* * * * *